US006073709A

United States Patent [19]

Hensley

[11] Patent Number: 6,073,709

[45] Date of Patent: Jun. 13, 2000

[54] SELECTIVE APPARATUS AND METHOD FOR REMOVING AN UNDESIRABLE CUT FROM DRILLING FLUID

[75] Inventor: Gary L. Hensley, Kingwood, Tex.

[73] Assignee: Hutchison-Hayes International, Inc., Houston, Tex.

[21] Appl. No.: 09/060,046

[22] Filed: Apr. 14, 1998

[51] Int. Cl.[7] ..... E21B 21/00; E21B 21/06

[52] U.S. Cl. ..... 175/207; 175/57; 175/206; 209/208; 209/724; 209/725; 209/10; 166/267

[58] Field of Search ..... 175/66, 57, 206, 175/207; 166/267; 209/208, 210, 724, 725, 726, 728, 10

[56] References Cited

U.S. PATENT DOCUMENTS

| | | | |
|---|---|---|---|
| 2,870,990 | 1/1959 | Bergey | 175/66 |
| 3,070,291 | 12/1962 | Bergey | 210/101 X |
| 3,737,037 | 6/1973 | Bone, III | 175/66 X |
| 3,964,557 | 6/1976 | Juvkam-Wold | 175/206 X |
| 4,482,459 | 11/1984 | Shiver | 210/639 |
| 4,571,296 | 2/1986 | Lott | 209/211 |
| 4,670,139 | 6/1987 | Spruiell et al. | 210/167 |
| 5,107,874 | 4/1992 | Flanigan et al. | 175/206 X |
| 5,129,649 | 7/1992 | Jackson | 175/206 X |
| 5,190,645 | 3/1993 | Burgess | 209/416 X |
| 5,344,570 | 9/1994 | McLanchlan et al. | 175/206 X |
| 5,454,957 | 10/1995 | Roff | 175/66 X |
| 5,494,584 | 2/1996 | McLanchlan et al. | 175/206 X |
| 5,882,524 | 3/1999 | Storey et al. | 175/66 X |

*Primary Examiner*—Eileen Dunn Lillis
*Assistant Examiner*—Jong-Suk Lee
*Attorney, Agent, or Firm*—Gunn & Associates, P.C.

[57] ABSTRACT

A skid mounted first and second stage centrifuges, each being provided with an input pump. Drilling mud is delivered to the first pump, the first stage and then into a tank for storing temporarily the liquids separated from the mud. The heavier weight components are segregated, stored and later added back to the liquid discharge of the second stage to provide an output stream of drilling mud having a specified weight for use in drilling. The lighter weight components are removed at the second stage and are discarded to clean the mud. A control system provides for operation and control without overloading.

47 Claims, 2 Drawing Sheets

SELECTIVE APPARATUS AND METHOD FOR REMOVING AN UNDESIRABLE CUT FROM DRILLING FLUID

BACKGROUND OF THE INVENTION

1. Field of the Invention

This disclosure sets out a system to be used with a drilling rig, fluid system, and more particularly a system for removing undesirable cut from the drilling fluid.

2. Background of the Invention

When an oil well is drilled, it is necessary to drill the well with drilling fluid. The drilling fluid is provided to lubricate the drill bit, and carries away cuttings by flowing upwardly in the annular flow space around the drill string. The drilling fluid is pumped down the drill string to pick up the cuttings and other debris. Commonly, the drilling fluid is water but it is sometimes made with an oil or oil based carrier. Generally, various heavy metal or other minerals are added to give it a weight and a selected viscosity. The viscosity is obtained from clay or clay products. The drilling mud becomes slick to the touch so that it provides a lubricating benefit.

When drilling into a high pressure formation, safety is enhanced by incorporating a weight component to the drilling mud. Common weight additives are barium sulfate. Water has a weight of about 8.4 pounds per gallon. The weight of the drilling mud can be increased to as much as 17 or 18 pounds per gallon by adding the weight materials. Occasionally, higher weights are achieved also by addition of these or other added weight materials. The weight materials have a relative density of around 4.0 compared to water (a density of 1.0).

After circulation through the well, the drilling mud will pick up particles of the earth formations that are penetrated by the drill bit. It is a relatively easy thing to clean the drilling mud provided the cuttings are primarily heavy rock. Also, the cuttings are easily removed where they form large particles. They can be readily removed when the drilling mud is recycled by passing the drilling mud through a set of screens. The mud is recycled at the surface on return from the well borehole by flowing up through the annular flow space around the drill string. It flows out of the annular flow space into a mud pit. Ultimately it is recycled back through the mud pump. While flowing from the well to the mud pit and then back to the pump, the mud typically is treated by a number of devices to restore the mud to the original condition. The mud is transferred through any of several devices including degassers, shale shakers, desanders and other cleaning devices. At times, the mud will simply be permitted to sit in an open pit. This enables the heavy particles in it to settle to the bottom. The mud is cleaned by settled heavy particles. Gas bubbles also are removed so that entrained gas bubbles do not create a risk of explosion by accumulating odorless natural gas around the mud pits. Gas cut mud is too light; the mud weight may be deceptively light.

In many ways, separation techniques applied to the drilling mud run into problems because of the difficulty of separating the desirable added components along with those retrieved from the well. The present disclosure is a method and apparatus for selective removal of trash or debris in the mud stream. The mud flow is made of several components including water which has a specific gravity of about 1.00 (assumed to be fresh water), and weight materials added to it which have a specific gravity of about 4.0. Sometimes, and dependent on the nature of the formation penetrated, the mud will be commingled with cuttings from sand and shale formations (a specific gravity of about 2.6). Sand cuttings are more easily removed. Shale cuttings however are difficult in that the shale is derived from formations incorporating a low grade clay. The specific gravity 2.6 of the shale formations is such that it is difficult to sort or separate. It cannot be wholly removed by sieves or screens. It is not in the form of particles sufficiently large that such screens will catch the particles. Moreover, it is dissolved and enters the solution so that no amount of mechanical screening or filtration can remove it. That creates a problem in recycling the mud. The drilling fluid therefore has to be replaced. Replacement of the drilling fluid is quite expensive.

In drilling a well, and especially a deep well, the problems are minor at shallow depth and become notable with depth. Typically, the first several hundred feet of drilling will be accomplished in just a day or so and is drilled rather rapidly. The problem arises at greater depths where the drill bit penetrates several formations of shale. The clay that is in the shale will dissolve, thereby changing the physical characteristics and performance of the drilling mud. Mud will no longer exhibit the integrity necessary for continued reuse. As the drilling mud is cut with added well bore materials, it ultimately is necessary to dispose of the entire batch. At that point, the well is quite deep, and the amount of mud required for replenishment can be several hundred barrels, indeed as much as 2000 barrels of fluid. This is expensive with a water based mud. It is even much more expensive with an oil based mud. It is not uncommon to have as much as $1,000,000 worth of drilling fluid solvents mixed into the drilling fluid and in circulation in a well at that moment. Some drilling fluids cost as much as $300 per barrel in 1998 prices. Easily, a single well can tie up $1,000,000 worth of drilling fluid at a given moment. The life of the drilling fluid is protected and extended by the present apparatus. Moreover, the method of sorting out the components that are desirable from those that are undesirable is set forth.

SUMMARY OF THE INVENTION

The present apparatus is a device which is adapted to be mounted on a skid. It is installed at a drilling rig. It is preferably skid mounted so that it readily operates at a given location, and is then truck mounted and moved to another location for subsequent operation.

The apparatus of the present disclosure is provided with mud returned from the well borehole. The mud is transferred by a pump to a tank and then is delivered from the tank through a first centrifuge. The first centrifuge removes the heavier components. They are delivered from the first centrifuge. The output has the form of heavier particles which are delivered moist or in a wet slurry. While drying does occur to a measure, the system is operated so that significant and substantial recovery of all the expensive weight material is removed from the mud. In situations where the fluid is an oil based mud, the oil can be recovered also.

This disclosure is directed to an improved, portable, self-contained mud processing system. It uses first and second stage centrifuges. The first stage is operated so that the heavy weight materials of importance are removed. This involves recovering the components of the weight material which have a specific gravity of about 4.0. By judicious adjustment of the throughput and weight of separation accomplished. The weight materials will be recovered substantially free of the lighter components. The lighter components typically will include materials which do not help. In general, they have a specific gravity of about 2.5 or less.

It is not uncommon for clay materials to have a specific gravity in that range. The clay materials making up the shale are thus recovered in the second stage of centrifugal separation. By using two separate stages, the heavy weight materials of value are removed and placed back in the solvent. Whether the solvent is water or expensive oil, this permits it to be recycled several times through the mud system. Moreover, the present apparatus sets out a control so that adequate pump flow is maintained to feed the first and second stage centrifuges. They are provided with a positive pump fluid flow input. In addition, they are provided with that input subject to safe control so that the centrifuges are not flooded. This enables the centrifuges to operate at the desired specific gravity separation points. Both stages discharge the lighter solvent and heavier ingredients removed from it. The heavier component are discharged with a small amount of solvent so that they form a slurry.

The apparatus of this disclosure is skid mounted. It can be lifted off a truck and installed at the desired location. At that location, the equipment is then operated readily by merely furnishing a connection with the mud pit. It operates with electrical power. The system incorporates a controller which monitors the operation of the pumps and centrifuges. They are operated to achieve optimum separation.

The present apparatus is summarized as a skid mounted unit incorporating first and second stage centrifuges. The input is through a mud line connected from the mud pit or other point in the mud system.

Storage tanks are included also. The input connects through a first positive displacement pump and then through a second positive displacement pump. The system also utilizes appropriate sensors which monitor the state or condition of the two pumps and centrifuges. Signals are provided to a controller system which monitors operation to avoid system overload.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENTS

Figure 1A:
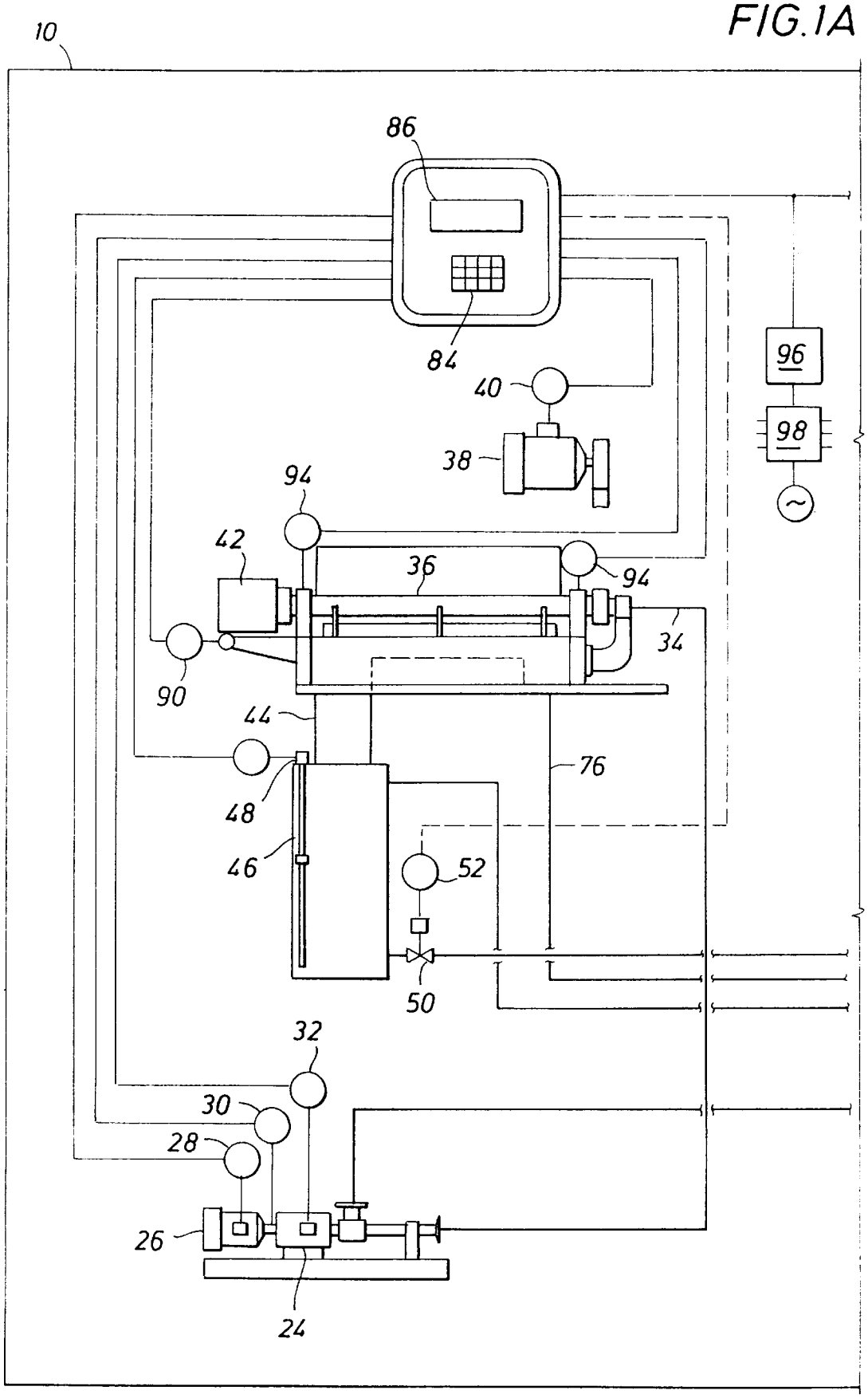
FIGS. 1A and 1B is a block diagram schematic showing the apparatus of this disclosure including appropriate pumps and centrifuges subjected to control by a set of sensors cooperative with an operator input keypad and CPU system.
Figure 1B:
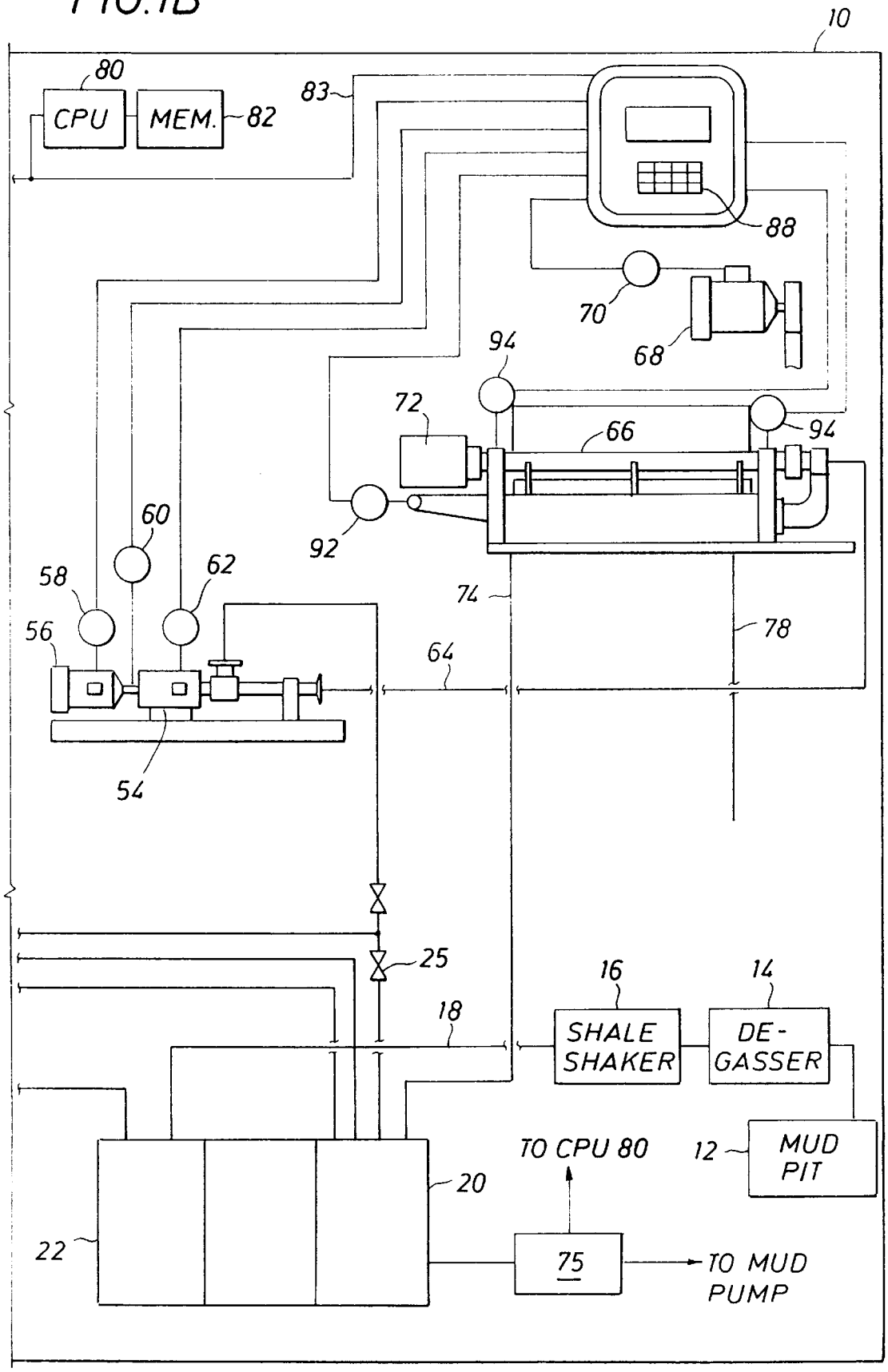

Going to FIGS. 1A and 1B, the present apparatus comprises a skid 10 which supports all of the equipment shown in the drawing. The present invention 10 is installed with a mud system. The mud system is assembled at the drilling rig. It is located adjacent to the rig and typically includes a set of mud pits 12 which receive the used mud from the well borehole. The mud delivered to the mud pits is transferred to a degasser 14 and then a shale shaker 16. These are included to remove some of the components collected in the mud stream from drilling. For instance, there is the risk of explosion by natural gas carried in the mud. The degasser 14 reduces the amount of gas in the mud. The mud is flowed through a shale shaker 16 which picks up large particles which are collected on screen in the shale shaker. They are removed from the mud. The mud flows through the screen and into a mud line which is connected to the equipment on the skid. The mud line 18 is an input line which is connected from elsewhere. The skid 10 supports two pumps and two centrifuges connected in series. The system will be described in series first and later in parallel.

The skid mounted equipment includes a first storage tank 20. There is a second storage tank 22. Elective storage tanks are also included and can be optionally connected. The line 18 is input to the tank 22. Mud is taken from the tank 22 by a motor driven pump 24 which is powered by an electric motor 26. The motor 26 is connected to a power measuring device. If need be, this can be a watt meter. Ordinarily, it is just as effective to provide a current transducer 28 for measurement of the power consumed by the device. In addition, the pump 24 is provided with a mud flow sensor 30. The system is also provided with a motor operator 32 which controls the motor. The mud from the tank 22 is thus delivered with positive displacement through a mud flow line 34 input to a first stage centrifuge 36. The centrifuge 36 is provided with an input at the right hand end. It is powered by a motor 38 which again is connected with a current sensor 40. Power consumption of the motor and hence load on the motor is generally determined by the current measured by the current sensor 40. The motor 38 rotates the components of the centrifuge, thereby imparting power to a bowl cooperating with a screw conveyor in the bowl. They are operated at high speeds, typically rotating at 3200 rpm. However, there is a speed deferential which is provided between the two by a gear box 42. The gear box assures that the screw conveyor scrolls thereby transferring the dry ingredients to the right hand end of the conveyor. The centrifuge delivers liquid through the outlet line 44. That is delivered into a surge tank 46. The tank 46 has a level sensor 48. It is drained from the bottom through an opening valve 50 connected with a motorized valve operator 52. The output line with a valve 25 closed, is input into a second pump 54 driven by a motor 56. The motor 56 operation is measured by a current sensor 58. A flow sensor 60 measures the flow through the pump. A motor operator 62 is connected to the motor and connects elsewhere as will be described. The output of the second pump is delivered to a feed line 64 which is input to a second centrifuge 66. The centrifuge 66 is powered by an electric motor 68 which again is provided with current measured through a current sensor 70. As before, it is equipped with a bowl and scrolling conveyor which are driven at a slight speed differential by a gear box 72 connected between the bowl and gear box. Liquid discharge from the centrifuge is through a line 74. That is returned to the storage tank 20.

The first stage is operated so that it discharges solids to a line 76. The second centrifuge is operated so it discharges solids to a line 78. The weight of materials in the lines 76 and 78 will be discussed below. Those weights are adjusted by a control system which is pertinent to the operation of the device. More will be noted concerning this later.

The numeral 80 identifies a CPU (central processing unit) attached to a system bus 83 equipped with an attached memory 82. In the preferred embodiment, the system is equipped with a key pad 84 and companion display 86 attached to the system bus 83. Optionally, a second key pad can be located at another point on the equipment attached to the system bus 83. The second key pad 88 is close to the second pump or it can be operated at a convenient location anywhere on the skid. The system utilizes a number of sensors which are connected at locations of importance. Perhaps it is noteworthy to add that the first and second centrifuges are protected by torque sensors 90 and 92. The sensors 90 and 92 cooperate with the CPU 80 through the system bus 83 as shown in FIG. 1, and measure the load applied to avoid tripping safety switches which are normally built into the first and second centrifuges.

Now, consider the operation of the equipment with a view of making the appropriate separations which are discharged for the heavy components in the lines 76 and 78. Assume as a first instance that heavy drilling mud is introduced to the system after it has taken on a substantial portion of dissolved formation ingredients. Assume for example that it was originally 18 pounds per gallon. That is a rather high number achieved by adding substantial quantities of barium sulfate. The barium sulfate has significant value. It is retrieved in the first centrifuge and the heavy or weight materials in the mud stream are discharged through the outlet 76. More specifically, the first centrifuge is operated so that the liquid discharge into the surge tank 46 has a reduced weight. The weight is reduced from about 18 pounds down to about 9 pounds per gallon, or perhaps even less. The discharged dry ingredients comprising the weight material are delivered through the line 76. While not precisely dry, they are discharged in the form of a wet slurry. The bulk of the water or other solvent is discharged through the outlet 44 and into the tank 46. The dry ingredients are captured. They are recycled and used again. In general terms, the dry ingredients having a specific gravity of about 4.0 are segregated from the other components picked up in the mud stream. Sand and other earth formation ingredients typically have a specific density of about 2.7 or so. The specific density defines an operating point for the first stage centrifuge. It is operated so that the dry ingredients are the heaviest ingredients. Therefore, the discharge of dry components comprises primarily the more costly, heavy, reusable weight materials. The weight materials delivered from the system at the outlet 76 are transferred to one of the containers such as the tank 20.

The system removes lighter materials from the once cleaned drilling fluid. The heavy weight drilling fluid introduced to the first stage centrifuge 36 is then lighter, and the fluid discharge is transferred through the pump 54 to the second stage centrifuge 66. As before, it is processed and the recovered solids are discharged through the outlet line 78. In general terms, this discharge removes the lighter components in the drilling mud. It removes drilling fluid components including the sand and shale derived components. They are discharged through the outlet 78. Generally, that constitutes a rejected portion of the mud stream and is removed from the mud system.

Consider the sequential reduction in mud weight. Assume that the feed to the skid supported system 10 has a mud weight of about 14 to 18 pounds per gallon. The heavier weight material components are removed in the first stage while the light weight components in the mud are removed in the second stage.

Operation to accomplish the foregoing result obtains a drilling fluid that is ready to be returned to the drilling process. It is cleaned up by removal of the lighter constituents which are removed by the second centrifuge. The weight material recovered by the first centrifuge is preferably added back into the solvent cleaned by the second centrifuge. Conveniently, this can be done in the second tank 20. The tank is provided with the weight materials removed by the first stage and the solvent from the second stage. If need be, the weight components can be further dried and stored temporarily including placement in a storage bin and the like.

The tank 20 serves as a repository for clarified drilling fluid. The solvent is delivered back to this tank and the dry ingredients are added to it so that the weighted drilling fluid can be restored and then recycled in the mud system. A suitable vacuum line connected with the tank 20 can be used for this purpose.

An important aspect of the present invention is the apparatus which responds to dynamics in operation to avoid overload. Briefly, each centrifuge is susceptible to overload by flooding the centrifuge. They are designed for a specified weight of material which is rotated. While this might represent a specific liquid volume, the liquid volume is not the only factor to define the weight of the material which is rotated by it. If a fixed volume is increased in weight from 12 pounds to 16 pounds per gallon, the weight goes remarkably high and requires greater torque. The equipment includes several sensors which measure the operative status of the centrifuges and the pumps which drive them for purposes of control. Assume as an example that the flow delivered to the system has a specified weight. Assume also that the dwell time of the flow in the system is such that the weight actually rotated in the first centrifuge represents 80% of maximum permitted. Should the weight of the spent drilling fluid go up, say from 16 to 18 pounds, then the increase in weight (of 2/16 or 12%) in the first centrifuge may cause an overload. The overload is normally sensed and results in shutdown of the equipment. In turn, this will interrupt the drilling process. To avoid that kind of problem, the operating additions of the first centrifuge are noted continuously. The electric current to the motor is measured by the sensor 40. The torque is measured by the sensor 90. As the load on the first centrifuge is increased, a signal is formed and transmitted to the CPU 80 via the system bus 83 as shown in FIG. 1. This signal is then used to make a change in operation. One way to change the operation is to reduce the throughput of the pump 24. The pump is operated with a flow sensor 30. When the flow becomes excessive, the flow rate is reduced. This can be reduced by simply reducing the speed of the pump motor 26. In turn, that will reduce the speed of the pump and also indicate that fact by reducing the measured current.

When the foregoing occurs, the amount of weight rotated in the centrifuge is then reduced. As the throughput is decreased, the torque required for safe operation is therefore reduced.

The pump 24 is the input device for the first stage separator. Monitoring of the operative status of both is carried out. This is done in conjunction with monitoring the level in the surge tank 46. The level is measured by the sensor 48. That level is adjusted by opening or closing the valve 50. The valve 50 is opened and controlled remotely by the operator 52. That assures that the tank 46 does not overflow. The partially clean drilling fluid is delivered by the system for recycling.

One aspect of the dual stage arrangement is to segregate to the heavy weight materials, save them and restore them to the centrifuge.

Method of Removing Selected Weight Materials

Assume that a heavy but dirty stream of drilling mud is provided to the apparatus 10. Assume that it is a water base drilling mud having the maximum added quantity of barium sulfate or other weight materials having a specific density of about 4.0. Assume also that the mud has picked up an unacceptable amount of ground shale from passing through a shale formation and that much shale is in the solution. The flow is delivered at a specified rate into the tank 22. The pump 24 delivers it at a specified flow rate to the first centrifuge. The first centrifuge is operated to remove the weight materials which have a specific density of about 3.5 or greater. This removed portion is valuable. It is segregated at the outlet line 76. While partially dried, it is not totally dried. It is delivered in the form of a particulate stream with some liquid and may be deemed a very heavy slurry. The liquid discharge 44 from the first centrifuge is delivered to the tank 46. By appropriately measuring and controlling the level in the tank, the valve 50 is opened and drilling fluid is delivered to the second pump 54. That is forced into the second centrifuge 66. Another separation is made and that centrifuge and the lighter components are separated. Typically, the drilling fluid is reduced by the first centrifuge from a high weight of perhaps 15 to 18 pounds down to a low weight of about 9 pounds or so. In the second centrifuge, the liquid discharge at the port 74 is even lighter, i.e., it approaches the weight of water. The solids removed through the port 78 are thrown away. The liquid recovered from the line 74 is delivered to the tank 20. The heavy valuable weight materials from the line 76 are input to the tank 20. This recombines the heavy weight material with the mud stream thereby restoring it to the raised or elevated weight. At that juncture, the refurbished drilling mud can be delivered from the tank 20 back to the mud pit. The refurbished mud then has a weight again approaching the desired weight for the system. For instance, if the drilling process at that moment requires a mud weight of 16 pounds, it is substantially accomplished by restoring the weight material back to the tank 20 and combining it with the refurbished mud flow.

In effect, the foregoing process removes the very light materials which degrade the drilling fluid. The light components are removed and discarded because they derive primarily from the formations penetrated by the drilling process. The weight materials are kept. They are restored to the mud stream. Very little makeup is required to be added. To the extent that there is any loss, it is relatively small, so the process can continue by recycling the drilling mud after refurbishing with this procedure.

The foregoing assumes that the solvent is water. In fact, it is quite effective with water but it is even more beneficial where oil base drilling fluids are concerned. They cost much more and are economically more valuable when recirculated. The reclaimed drilling fluid in that instance reduces the ongoing cost of makeup. It also enables the oil base drilling fluid to be reused many times. This is especially important in difficult drilling situations where the well is deviated to the horizontal to pick an example.

In another aspect, the control system 80 responds carefully and routinely to the operation of the equipment. That is an important factor in its operation. Care is taken so that the equipment is used in the optimum range but without overloading. The sensors connected to the first and second centrifuges measure the electric current provided to the drive motors 38 and 68. The torque sensors 90 and 92 measure the torque required for operation of the two centrifuges. When they overload, the motors are switched off to prevent damage to the equipment. An overload with a subsequent cut off is very disruptive. It is disruptive in part because it is difficult to restart the centrifuges filled with weight material. In effect, they have to be cleaned. That is not easily done. It is better to use the control system featuring the CPU 80 to prevent overload. Overload can be controlled readily. The torque measurement is made continuously. A given torque load is associated with a particular flow rate defined by the pumps 24 and 54. As any device approaches an overload condition, the pumps 24 and 54 are slowed. They are monitored as measured by the flow sensors 30 and 60. By dropping the output, the centrifuges have reduced input. The CPU 80 forms a current control signal to a current controller 96. In turn, it controls the actual current delivered by the power system 98. In most installations, three phase power is distributed to the motors. Motors of the size needed to pump these volumes are preferably three phase motors. They are provided with adjustable current levels to vary their output.

A reduction in the input reduces the volume in the centrifuges as they continue to operate. This enables a change in the torque and thereby prevents overload. As a protective device, each centrifuge is equipped with left and right bearing assemblies which are monitored continuously also. These are monitored for temperature and vibration. This includes the sensors 94 on both centrifuges. The CPU 80 is also operated to maintain an appropriate level in the tank 46. It can be used in conjunction with the level sensor 48 and the valve 50 to regulate the transfer from the first to the second centrifuge.

Parallel Operation

The prior operation is serial operation of the two pumps and downstream centrifuges. But, this skid mounted system is switched to a parallel system. The input is connected to both pumps and both centrifuges so that both operate on the feed from the line 18. By opening the valve 25, the feed is directed to the second pump; the mud from the first stage is stopped by closing the valve 50. Parallel operation has an advantage. The volume handled can be much greater.

In general terms, parallel operation differs from serial operation. Generally, the system can give controlled mud weight or controlled viscosity. The mud output is directed through a mud viscosity meter 75. The measured viscosity is signalled to the CPU. The CPU instructs changes in mud component separation to change viscosity. For instance, a change in flow rate into a centrifuge changes the dwell time which, in conjunction with a change in RPM, will change the heavier particle separation. This will change the removed component mix and mix of remaining solids in the mud vehicle. In very general terms, the mud viscosity meter 75 enables routine system observation.

While the foregoing is directed to the preferred embodiment, the scope thereof is determined by the claims which follow:

What is claimed is:

1. A drilling rig mud reclamation system comprising:

(a) a unitized structure having a mud inlet line to be connected to deliver mud from the drilling rig;

(b) a first stage centrifuge provided with the mud from the drilling rig for separating heavy weight solid components thereof and forming a first stage liquid discharge;

(c) a second stage centrifuge provided with the first stage liquid discharge for removing lighter weight solid components in the first stage liquid discharge including those added during drilling;

(d) a tank for remixing the heavy weight solid components from the first stage centrifuge with the liquid discharge from the second stage centrifuge to form a refurbished drilling mud having a specified weight; and (e) a sensor operated control system wherein (i) said sensor system monitors operating parameters of said first and said second stage centrifuges, (ii) said control system responds to signals from said sensor system to regulate said operating parameters of said first and said second stage centrifuges to separate said heavy weight solid components of a predetermined weight.

2. The system of claim 1 including separate first and second stage pumps connected to the inputs of said first and second stage centrifuges.

3. The system of claim 2 wherein said second stage pump has an input for the liquid discharge of said first stage centrifuge.

4. The system of claim 3 wherein said first and second stage pumps are serially connected to first and second flow sensors at the outputs thereof.

5. The system of claim 1 wherein said first stage liquid discharge is input into a liquid receiving tank and said tank connects through a valve controlled outlet to said second stage.

6. The system of claim 5 including a liquid volume sensor measuring liquid in said tank to enable net tank inflow and discharge.

7. The system of claim 6 including an operator for said tank valve.

8. The system of claim 1 wherein:

(a) said first stage centrifuge has liquid and solid outlets so that said liquid outlet delivers said first stage liquid discharge therefrom;

(b) said solid outlet delivers a flow of said heavy weight solid components therefrom, and (c) said first stage liquid discharge and said flow of heavy weight solids is limited by a flow sensors and controlled pump input thereto.

9. The system of claim 8 wherein said first stage centrifuge and controlled pump are serially connected so that said mud from said drilling rig flows therethrough and said first stage centrifuge and said pump are operated by separate electric motors and said motors are monitored during the operation so that the operation is limited to avoid overloading said first stage centrifuge.

10. A drilling mud apparatus comprising:

(a) serially connected first and second stage centrifuges, each thereof separating a heavier component wherein drilling mud is input into said first stage centrifuge, and said first and second stage centrifuges are serially connected so that a first stage liquid discharge from said first stage centrifuge is input to the second stage centrifuge and (i) said first stage centrifuge removes a first weight material component from the drilling mud, and (ii) said second stage centrifuge removes a second weight material component from said first stage liquid discharge (b) a power system for operating said first and second stage centrifuges;

(c) a controller for the power system;

(d) sensors connected to said first and second stage centrifuges to measure the operative conditions thereof and form sensor signals over time to said controller; and (e) a controller input to enable operator input of control instructions so that said first and second stage centrifuges are operated so that (i) said first weight material component is heavier than said second weight material component (ii) a lower limit of weight of said first weight material component is defined by input to said controller, and (iii) said first weight material component is combined with a second stage liquid discharge from said second stage centrifuge thereby producing cleaned drilling mud.

11. The apparatus of claim 10 including a flow sensor measuring an input flow signal of said drilling mud to said first stage centrifuge wherein the measured input signal is provided to said controller, and said controller controls said first stage centrifuges below centrifuge overload conditions.

12. The apparatus of claim 11 wherein an input pump delivers said drilling mud input to said first stage centrifuge, and said controller monitors said pump and said first stage centrifuge operating conditions by measuring power required thereby; and said controller prevents first stage centrifuge overload.

13. The apparatus of claim 10 wherein said controller input includes a first input from a first stage flow sensor and a second input form a second stage flow sensor and said controller utilizes said first and second inputs to measure flow through said first and second stage centrifuges and said controller limits operation said first and second stage centrifuges.

14. The apparatus of claim 10 including first and second pumps operated by electric motors and said first and second stage centrifuges are operated by electric motors; and said power system powers all of said electric motors while operating said motors by monitoring motor power.

15. The apparatus of claim 14 wherein said controller comprises:

(a) a CPU with memory;

(b) an operator input to said CPU;

(c) sensor input to said CPU;

(d) a controlled power output for said motors; and (e) a connected power source provided controller directing power to said motor through said power output.

16. The apparatus of claim 10 including a pump motor connected to a pump and further having:

(a) a pump current sensor;

(b) a pump flow sensor;

(c) a motor operator to turn said motor on; and (d) a power source for pump operation.

17. The apparatus of claim 16 including:

(a) controller connections from said current and flow sensors to input the signals therefrom; and (b) a controller input for setting said controller to operate said pump and said first stage centrifuge.

18. The apparatus of claim 16 including a torque sensor measuring the load on said first stage centrifuge and providing the measured torque to said controller.

19. The apparatus of claim 16 wherein (a) said first stage flow sensor measures said first stage centrifuge mud input;

(b) said second stage flow sensor measures input to said second stage centrifuge; and (c) said first and second stage flow sensors connect serially to said first stage to enable measurement of said first weight material component removed by said first stage centrifuge.

20. A method of refurbishing a stream of drilling mud from a drilling rig where the drilling mud is degraded by cuttings from the well borehole during drilling, wherein the method comprises the steps of:

(a) delivering a mud stream from the drilling rig wherein the mud carries cuttings that degrade mud performance;

(b) pumping the mud stream through a first stage centrifuge to remove heavy weight components therein above a specified weigh, wherein said specified weight is defined by input to a controller which cooperates with sensors thereby controlling operating parameters of said first stage centrifuge;

(c) delivering remaining mud components after separation of the heavy weight components to a second stage centrifuge and removing lighter weight components at the second stage centrifuge and discharging remaining mud components;

(d) combining the removed heavy weight components from the first stage centrifuge with the remaining mud components from the second stage to form an output stream of drilling mud having a specified weight.

21. The method of claim 20 including the step of pumping the drilling mud through by a first pump into the first stage centrifuge, measuring the pump flow rate, and operating the first stage centrifuge and pump at a controlled rate to avoid overloading the first stage centrifuge.

22. The method of claim 21 including the added step of measuring first stage centrifuge torque and second stage centrifuge torque to avoid overload said first and said second stage centrifuges.

23. The method of claim 21 including the step of measuring first and second stage mud flow rate.

24. The method of claim 23 including the step of measuring first and second stage mud flow rate at first and second pumps input to said first and second stage centrifuges, and controllably accumulating mud between said stages to thereby vary the second stage centrifuge operation independent of said first stage flow rate.

25. The method of claim 20 wherein said controlling operating parameters comprises the steps of controlling:

(a) first stage mud flow rate;

(b) second stage mud flow rate;

(c) limiting first stage torque;

(d) limiting second sage torque; and (e) temporarily storing mud between the first and second stages centrifuges to enable the flow rate of the second stage centrifuge to vary from the flow rate of the first stage centrifuge.

26. The method of claim 25 including the step of flowing said first stage heavy weight components into a tank, flowing said second stage remaining components into the tank to form the output stream of drilling mud.

27. The method of claim 25 wherein the first stage centrifuge removes the heavy weight components having a relative density of about 4. and the second stage removes components resultant from drilling through shale, and the second stage remaining components comprise the solvent for mixing into the heavy weight components.

28. The method of claim 25 including the step of storing the drilling mud in a tank, measuring the drilling mud volume in the tank, and pumping the drilling mud from the tank to the second stage centrifuge.

29. The method of claim 28 including the step of measuring tank level to measure volume.

30. The method of claim 25 including the step of controlling operation of said first and second centrifuge stages from a controller to change mud flow rates.

31. A drilling rig mud reclamation system comprising:

(a) a unitized structure having a mud inlet line to be connected to deliver mud from the drilling rig;

(b) a first centrifuge provided with the mud from the drilling rig for separating heavy weight solid components thereof and forming a first liquid discharge;

(c) a line and valve system connecting to the mud inlet line, wherein said line and valve system (i) when set in a first configuration, provides a serial flow of mud through the first centrifuge and a second centrifuge, said second centrifuge is provided with the first stage liquid discharge for removing lighter weight solid components in the first stage liquid discharge and forming a second liquid discharge, and (ii) when set in a second configuration, provides a parallel flow of mud through said first and second centrifuge.

32. The system of claim 31 including separate first and second pumps serially connected to the inputs of said first and second stage centrifuges.

33. The system of claim 32 wherein the liquid discharge of said first centrifuge is input to said second pump when said line and valve system is set to provide serial flow.

34. The system of claim 31 wherein first and second stage pumps are serially connected to first and second flow sensors at the outputs thereof.

35. The system of claim 31 wherein said first stage liquid discharge is input into a liquid receiving tank and said tank connects through a valve controlled outlet to said second stage pump.

36. The system of claim 35 including a liquid volume sensor measuring liquid in said tank to enable net tank inflow and discharge.

37. The system of claim 31 wherein, in said second configuration, said first and second centrifuges both have liquid and solid outlets so that said solid outlets deliver heavy weight solids therefrom, and first and second centrifuge flow is limited by flow sensors cooperative with controlled pump input into each said first and second centrifuge.

38. The system of claim 32 wherein said first and second pumps are serially connected so that input mud flows therethrough and said first centrifuge and said first pump are operated by separate electric motors and said motors are monitored during operation so that operation is limited to avoid overloading.

39. The apparatus of claim 31 further comprising:

(a) a power system for operating said first and second centrifuges;

(b) a controller for the power system;

(c) sensors connected to said first and second centrifuges to measure the operative conditions thereof and form sensor signals over time to said controller; and (d) a controller input to enable operator input of control instructions so that said first and second centrifuges remove specified components of the drilling mud to enable the drilling mud to be cleaned and returned for drilling having a specified heavier weight material component in the drilling mud.

40. The apparatus of claim 39 including a flow sensor measuring mud input wherein the measured input signal is provided to said controller, and said controller controls said first and second centrifuges below centrifuge overload conditions.

41. The apparatus of claim 40 wherein an input pump delivers mud input to said first centrifuge, and said controller monitors said pump and said first centrifuge operating conditions by measuring power required thereby; and said controller prevents overload.

42. The apparatus of claim 39 wherein said controller input includes a first input from a first flow sensor and a second input form a second flow sensor and said controller measures the flow of said first and second centrifuges and said controller limits said first and second centrifuges.

43. The apparatus of claim 39 including (a) first and second pumps each operated by an electric motor;

(b) said first and second centrifuges are each operated by an electric motor; and (c) said power system powers said electric motors while operating said motors by monitoring motor power.

44. The apparatus of claim 43 wherein said controller comprises:

(a) a CPU with memory;

(b) an operator input to said CPU;

(c) sensor input to said CPU;

(d) a controlled power output for each of said motors; and (e) a connected power source provided controller directing power to each of said motors through said power output.

45. The apparatus of claim 39 including a pump motor connected to a pump and further having:

(a) a pump current sensor;

(b) a pump flow sensor;

(c) a motor operator to turn said motor on; and (d) a power source for pump operation.

46. The apparatus of claim 43 including a torque sensor measuring the load on said first centrifuge and providing the measured torque to said controller.

47. The apparatus of claim 43 wherein:

(a) a first flow sensor measures mud input to said first centrifuge;

(b) a second flow sensor measures input to said second centrifuge; and (c) said flow sensors connect serially to said first centrifuge to enable measurement of mud removed thereby.

* * * * *